United States Patent [19]

Aono et al.

[11] 4,008,087

[45] Feb. 15, 1977

[54] PHOTOGRAPHIC LIGHT-SENSITIVE MATERIAL

[75] Inventors: Masazumi Aono; Shuichi Shindo; Takushi Miyazako, all of Minami-ashigara, Japan

[73] Assignee: Fuji Photo Film Co., Ltd., Minami-ashigara, Japan

[22] Filed: Aug. 4, 1975

[21] Appl. No.: 601,953

[30] Foreign Application Priority Data

Aug. 5, 1974 Japan ..... 49-89606

[52] U.S. Cl. ..... 96/69; 96/67; 96/84 R; 96/85; 96/87 A; 96/87 R

[51] Int. Cl.[2] ..... G03C 1/76; G03C 1/84; G03C 1/86; G03C 1/78

[58] Field of Search ..... 96/84 R, 67, 85, 87 A, 96/87 R, 114, 114.2, 114.5, 69

[56] References Cited

UNITED STATES PATENTS

| | | | |
|---|---|---|---|
| 3,753,716 | 8/1973 | Ishihara et al. | 96/87 A |
| 3,791,831 | 2/1974 | von Bonin et al. | 96/87 A |
| 3,856,530 | 12/1974 | van Paesschen et al. | 96/87 A |
| 3,877,942 | 4/1975 | Nagatomo et al. | 96/87 R |
| 3,877,947 | 4/1975 | Tsuji et al. | 96/87 R |
| 3,938,999 | 2/1976 | Yoneyama et al. | 96/114 |

*Primary Examiner*—Jack P. Brammer
*Attorney, Agent, or Firm*—Sughrue, Rothwell, Mion, Zinn & Macpeak

[57] ABSTRACT

A photographic light-sensitive material comprising a support having thereon at least one silver halide photographic layer and at least one layer containing a styrene-maleic acid copolymer in which about 10 to 70 mol % of the carboxylic acid groups of the styrene-maleic acid copolymer is esterified with a compound represented by the following formula (I)

(I)

wherein R represents a hydrogen atom, an alkyl group having 1 to 4 carbon atoms or a phenyl group, and *n* is 1 or 2.

7 Claims, 1 Drawing Figure

ESTERIFICATION DEGREE % AS MEASURED AT 23° C AND 30% RH

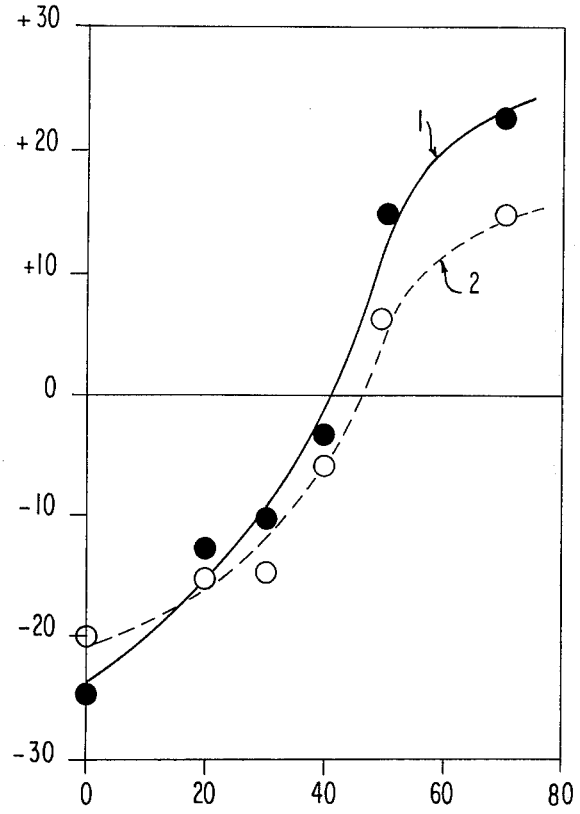
ESTERIFICATION DEGREE % AS MEASURED AT 23° C AND 30% RH

PHOTOGRAPHIC LIGHT-SENSITIVE MATERIAL

BACKGROUND OF THE INVENTION

1. Field of the Invention

This invention relates to a photographic light-sensitive material, and more particularly, to a photographic light-sensitive material which is rendered antistatic.

2. Description of the Prior Art

In the preparation of photographic light-sensitive materials or in the use thereof, static electric charges are generated in the photographic light-sensitive materials and the charges accumulate, which cause various undesirable phenomena. This accumulation of static charge results from the contact of a film with a roller, the friction of a film with another material in a camera, the contact of the emulsion surface of a roll film with the back surface at the opposite side of the support of the film, and the like, and it is subsequently discharged. The photographic light-sensitive materials are sensitized before image-wise exposure by this static phenomenon and produce irregular static marks after development. In general, as the sensitivity of the photographic emulsion increases, the emulsion becomes more susceptible to the discharge of static charge, thus resulting in an increase in static marks.

In order to prevent build-up of static charge in photographic light-sensitive materials, antistatic agents are generally used. Typical examples of antistatic charges are, in particular, electrically conductive surface active agents (e.g., anionic, cationic, nonionic surface active agents, etc.), and polymers (e.g., $\alpha,\beta$-unsaturated carboxylic acid copolymers such as polyacrylic acid or polymethacrylic acid, carboxymethyl cellulose, polycarboxylate salts, polystyrenesulfonate salts, etc.). However, since many of these antistatic agents can be dissolved only in water, these antistatic agents have poor wettability of coated layers as compared with antistatic agents which can be dissolved in organic solvents or both organic solvents and water. In particular, when photographic light-sensitive materials are rolled or stacked as sheets and are allowed to stand at high temperature and high humidity, the layer of an antistatic agent and an emulsion layer come into contact with each other. Therefore, when the photographic light-sensitive materials are separated from each other in this case, undesirable phenomena for photographic light-sensitive materials such as the occurrence of static marks, gloss or development mottle, or a delamination of the emulsion layer occur. Moreover, some surface active agents are transferred to the surface of the emulsion layer or penetrate to the support, so that they do not satisfactorily exhibit the intended antistatic effect.

For the above and other reasons and in view of the advantages in using a binder at the same time, organic solvents are often used in coating an antistatic agent. However, antistatic agents of the anionic type (particularly polymers) can not be dissolved in organic solvents in may cases. Moreover, although cationic surface active agents can be dissolved in organic solvents, it is very difficult to select stable cationic surface active agents since they influence the photographic properties of an emulsion (such as desensitization). From this point of view, copolymers with $\alpha,\beta$-unsaturated carboxylate salts have been proposed as described in U.S. Pat. Nos. 3,446,651 and 3,514,291, British Patent Nos. 1,155,997 and 1,267,732, Japanese Patent Publication Nos. 24158/71 and 24159/71, Japanese Patent Application (OPI) No. 3972/74 and Japanese Patent Publication No. 23827/74. However, solubility of these polymers in organic solvents (such as alcohols, esters, ketones or mixtures thereof), the anti-adhesion properties of these polymers to an emulsion layer, the transparency of a coated layer of these polymers, the stability of these polymers with time, and the like are insufficient, and therefore, the application of these polymers to photographic light-sensitive materials has not yet been put into practice.

SUMMARY OF THE INVENTION

Accordingly, a first object of this invention is to provide a photographic light-sensitive material which is rendered antistatic.

A second object of this invention is to provide a photographic light-sensitive material having excellent antistatic properties and anti-adhesion properties.

A third object of this invention is to provide a photographic light-sensitive material which is rendered antistatic and has no haze.

A fourth object of this invention is to provide a photographic film support suitable for use in the preparation of a photographic light-sensitive material which is rendered antistatic.

A fifth object of this invention is to provide an antistatic agent which is photographically inert and has good stability with time.

Various approaches in order to accomplish the above objects have now been studied and, as a result, surprisingly it has now been found that a styrene-maleic acid copolymer in which a maleic acid unit is esterified in a particular manner provides a specific effect as compared with such a copolymer in which the maleic acid unit is not so esterified.

Accordingly, the present invention provides a photographic light-sensitive material comprising a support having thereon at least one silver halide photographic layer and at least one layer containing a styrene maleic acid copolymer in which about 10 to 70 mol % of the carboxylic acid groups of the styrene-maleic acid copolymer is esterified with a compound represented by the following formula (I)

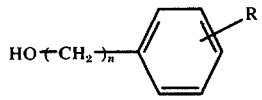

(I)

wherein R represents a hydrogen atom, an alkyl group having 1 to 4 carbon atoms or a phenyl group, and $n$ is 1 to 2.

BRIEF DESCRIPTION OF THE ACCOMPANYING DRAWING

The FIGURE is a graph showing the relation between the tribo-electric series and the esterification degree of styrene-maleic acid copolymers of this invention, wherein Curve 1 corresponds to the use of a stainless roller and Curve 2 corresponds to the use of a rubber roller.

DETAILED DESCRIPTION OF THE INVENTION

The styrene-maleic acid copolymers used in this invention contain many maleic acid units:

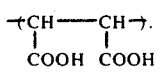

Copolymers in which at least one maleic acid unit is esterified are included in the range of this invention. Therefore, all of maleic acid units need not contain one or two esterified carboxyl groups, and it is only required for the copolymer, as a whole, to have at least one esterified carboxyl group. Copolymers comprising in combination, maleic acid units in which none of the carboxyl groups is esterified, maleic acid units in which only one of the carboxyl groups is esterified and maleic acid units in which both of the carboxyl groups are esterified, of course, included in this invention. In the esterification degree as used herein, a copolymer of styrene units and maleic acid units in which none of the two carboxylic acid groups of each maleic acid unit is esterified, the esterification degree is considered to be 0 mol %. In a copolymer of styrene units and maleic acid units in which only one of the carboxylic acid groups of each maleic acid unit is esterified, the degree of esterification is considered to be 100 mol %. Further, in a copolymer of styrene and maleic acid units in which both of the carboxylic acid groups of each maleic acid unit are esterified, the esterification degree is also considered to be 100 mol %. The copolymers of this invention preferably have an esterification degree of about 10 to 70 mol %, and for the carboxyl groups which are not esterified, one or more thereof (particularly 50 to 80 mol % of carboxyl groups which are not esterified) are preferably alkali metal salts such as sodium, potassium or lithium salts.

Particularly advantageous styrene-maleic acid copolymers are represented by the following general formula (II)

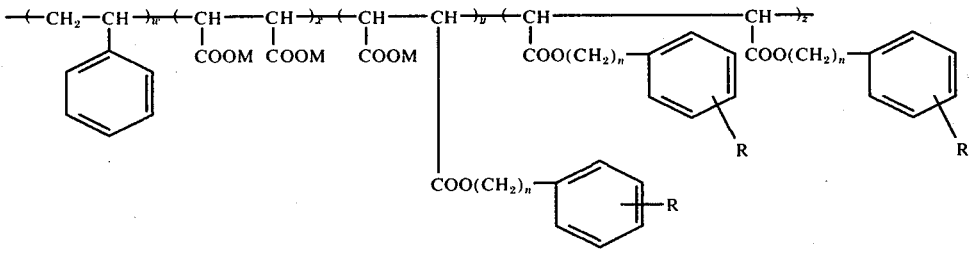

(II)

wherein $n$ is 1 to 2;

$w$ is 20 to 60 mol %;

$x$ is 0 to 40 mol %;

$y + z$ is 10 to 70 mol %;

$y$ is 0 to 70 mol %;

$z$ is 0 to 20 mol %;

M is an alkali metal atom such as lithium, sodium or potassium; and

R is a hydrogen atom, an alkyl group having 1 to 4 carbon atoms (such as a methyl, ethyl, propyl, isopropyl, butyl, sec-butyl or tert-butyl group) or a phenyl group.

The copolymers represented by the above general formula (II) can be produced by esterifying a usual styrene-maleic anhydride copolymer with an alcohol represented by the above formula (I) (preferably to an esterification degree of 10 to 70 mol %) and converting the remaining carboxyl groups partially or completely into alkali metal salts.

It is advantageous for the styrene-maleic acid copolymer used in this invention to have preferably a molecular weight of about 2,000 to 500,000, particularly preferably 5,000 to 50,000.

In preparing a coating composition containing the styrene-maleic acid copolymer, the copolymer is initially dissolved in an organic solvent, particularly, an alcoholic solvent such as methanol, ethanol, propanol, butanol, ethylene glycol, glycerol, cyclohexanol or mixtures thereof. The ratio of the styrene-maleic acid copolymer component and the solvent used depends upon the amount of the copolymer required. Generally, however, when the copolymer is coated at a coverage of about 5 to 500 mg/m$^2$, the coating composition preferably has a concentration of less than about 20 wt. %. A copolymer having a high esterification degree is soluble in an ester solvent such as methyl acetate, ethyl acetate, propyl acetate or butyl acetate. If desired, an auxiliary solvent can be added to this solution for various purposes, and examples of suitable auxiliary solvents are water, ketones such as acetone, methyl ethyl ketone, cyclohexanone or diacetone alcohol, halogenated hydrocarbons such as methylene chloride, ethylene chloride or carbon tetrachloride, phenolic compounds such as phenol or p-chlorophenol, acid esters such as ethyl acetate, butyl acetate or ethyl lactate, and glycol ethers such as methyl glycol or ethyl glycol. The auxiliary solvents serve, in some cases, as a swelling agent or a solvent for a support. The above solution can contain a matting agent (e.g., in an amount of about 0.1 to 50% by weight based on the weight based on the weight of the copolymer of this invention) such as silica particles, a latex, polyacrylonitrile particles or polystyrene particles, a moisture conditioning agent such as ethyl citrate, and a binder. Suitable binders which can be advantageously used include water-soluble binders such as natural high molecular weight materials (e.g., gelatin, casein, albumin, gum arabic, etc.) or synthetic high molecular weight materials (e.g., polyvinyl alcohol, polyvinyl pyrrolidone), and binders which are soluble in organic solvents, such as polyesters, vinylic polymers or cellulose derivatives. These binders can be used individually or as a mixture thereof.

It is particularly advantageous for the coating composition thus-obtained to contain about 0.1 to 5 g, particularly 0.05 to 2 g, of the styrene-maleic acid copolymer, 10 to 90 g of an organic solvent and, if desired, 90 to 10 g of an auxiliary solvent and 0.01 to 5 g of a binder per 100 g of the coating composition.

In general, the coating composition containing the styrene-maleic acid copolymer is particularly preferably coated on the surface of a support opposite to the surface on which the emulsion layer is coated (that is, as a so-called "backing layer") or on the uppermost surface at the emulsion layer side (that is, as a so-called "protective layer" or an "uppermost layer"). However, the copolymer of this invention can also be incorporated in other layers such as a silver halide emulsion layer, an antihalation layer, an intermediate layer or a filter layer.

The above-described coating composition can contain a polyhydric alcohol (e.g., in an amout of about 1 to 20% by weight based on the weight of the coating solvent employed) such as ethylene glycol or glycerol in order to improve the film strength of the coated layer.

Silver halide emulsions used in the invention can be prepared by mixing a solution of a water-soluble silver salt such as silver nitrate with a solution of a water-soluble halide (such as potassium bromide) in the presence of a solution of a water-soluble high molecular weight material such as gelatin. Silver halides which can be used include silver chloride, silver bromide, as well as mixed silver halides such as silver chlorobromide, silver bromoiodide or silver chlorobromoiodide.

The silver halide grains can be any shape such as a cubic or octahedral crystal form or a mixed crystal form thereof.

The grain diameter of the silver halide is not particularly restricted to uniform size.

The silver halide grains can be prepared by conventional methods. It is, of course, useful to prepare the grains by a so-called single or double jet method, a controlled double jet method, and the like. Moreover, two or more silver halide photographic emulsions, separately prepared, can be mixed, if desired. The crystal structure of the silver halide grains can be uniform throughout the grain can have a stratified structure in which the interior and the outer portion are different, or can be a so-called conversion type silver halide grain as described in British Patent No. 635,841 and U.S. Pat. No. 3,622,318. In addition, the silver halide grains can be of the type in which latent images are formed predominantly on the surface of the grains or of the type in which latent images are formed in the interior of the grains. The above photographic emulsions are described, e.g., in C.E.K. Mees T.H. James, *The Theory of the Photographic Process*, 3rd Ed., Macmillan, New York (1966); P. Grafkides, *Chemie Photographique*, Paul Montel, Paris (1957); etc., and can be prepared by various methods such as an ammonia process, a neutral process or an acid process.

The silver halide grains are, after the formation thereof, washed with water to remove the water-soluble salts as by-products (for example, potassium nitrate when silver bromide is prepared using silver nitrate and potassium bromide) from the system and then subjected to heat treatment in the presence of a chemical sensitizer such as sodium thiosulfate, N,N,N'-trimethylthiourea, a gold (I) thiocyanate complex salt, a gold (I) thiosulfate complex salt, stannous chloride or hexamethylenetetramine, thus increasing the sensitivity without making the grains coarser.

Hydrophilic colloids which can be used as a vehicle for the silver halide include gelatin, colloidal albumin, casein, cellulose derivatives such as carboxymethyl cellulose or hydroxyethyl cellulose, saccharide derivatives such as agar-agar, sodium alginate or starch derivatives, synthetic hydrophilic colloids such as polyvinyl alcohol, poly-N-vinyl pyrrolidone, polyacrylic acid copolymers or polyacrylamide, or the derivatives thereof or the partially hydrolyzed products thereof. If desired, a compatible mixture of two or more of these colloids can be used.

Of the above-described hydrophilic colloids, gelatin is most generally used, but the gelatin can be, either partially or completely, replaced with a synthetic high molecular weight material. Furthermore, the gelatin can be replaced with a so-called gelatin derivative, e.g., a product prepared by treating or modifying the functional groups contained in the gelatin molecule, such as the amino groups, imino groups, hydroxy groups or carboxyl groups present, with a compound having a group capable or reacting with these functional groups, or a graft polymer in which the molecular chain of another high molecular weight material is grafted to the gelatin.

Compound suitable for producing the above gelatin derivatives include, e.g., isocyanates, acid chlorides and acid anhydrides as described in U.S. Pat. No. 2,614,928; acid anhydrides as described in U.S. Pat. No. 3,118,766; bromoacetic acids as described in Japanese Patent Publication No. 5514/64; phenylglycidyl ethers as described in Japanese Patent Publication No. 26845/67; vinyl sulfone compounds as described in U.S. Pat. No. 3,132,945; N-allylvinylsulfonamides as described in British Patent No. 861,414; maleinimide compounds as described in U.S. Pat. No. 3,186,846; acrylonitriles as described in U.S. Pat. No. 2,594,293; polyalkylene oxides as described in U.S. Pat. No. 3,312,553; epoxy compounds as described in Japanese Patent Publication No. 26845/67; acid esters as described in U.S. Pat. No. 2,763,639; alkane sultones as described in British Patent No. 1,033,189; and the like.

Polymers which can be used for grafting to gelatin are described e.g., in U.S. Pat. Nos. 2,763,625, 2,831,767 and 2,956,884; *Polymer Letters*, 5, 595 (1967), *Phot. Sci. Eng.*, 9, 148 (1965) and *J. Polymer Sci.*, A-1, 9, 3199 (1971). Polymers and copolymers of the so-called vinylic monomers such as acrylic acid, methacrylic acid, derivatives of arcylic acid or methacrylic acid such as the esters, amides and nitriles thereof, and styrene can be used widely for this purpose. Particularly preferred are hydrophilic vinyl polymers which are somewhat compatible with gelatin, for example, polymers and copolymers of acrylic acid, acrylamide, methacrylamide, hydroxyalkyl acrylates, hydroxyalkyl methacrylates, etc.

The above silver halide emulsions can be chemically sensitized in a conventional manner. Suitable chemical sensitizers include, e.g., gold compounds such as chloroaurate salts or auric trichloride as described in U.S. Pat. Nos. 2,399,083, 2,540,085, 2,597,856 and 2,597,915; salts of noble metals such as platinum, palladium, iridium, rhodium or ruthenium as described in U.S. Pat. Nos. 2,448,060, 2,540,086, 2,566,245, 2,566,263 and 2,598,079; sulfur compounds capable of reacting with a silver salt to form silver sulfide as described in U.S. Pat. Nos. 1,574,944, 2,410,689, 3,189,458 and 3,501,313; stannous salts as described in U.S. Pat. Nos. 2,487,850, 2,518,698, 2,521,925, 2,521,926, 2,694,637, 2,893,610 and 3,201,254; amines; and other reducing compounds.

Various compounds can be added to the above photographic emulsions in order to prevent a reduction of sensitivity and the occurrence of fog during production, during storage and during the processing of the light-sensitive material. A number of such compounds are well known, for example, 4-hydroxy-6-methyl- 1,3,3a, 7-tetrazaindene, 3-methylbenzothiazole, 1-phenyl-5-mercaptotetrazole, as well as many heterocyclic compounds, mercury-containing compounds, mercapto compounds, metal salts, and the like.

Examples of such compounds which can be used are described in C. E. K. Mees and T. H. James, *The Theory of the Photographic Process*, 3rd Ed., pages 344 to 349, Macmillan, New York (1966) and the original references cited therein, and in the following patents: U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668, and 3,622,339; British Patent Nos. 893,428, 403,789, 1,173,609 and 1,200,188, etc.

The hardening of the emulsion can be effected in a conventional manner. Specific examples of the hardeners which can be used include aldehyde compounds such as formaldehyde or glutaraldehyde; ketone compounds such as diacetyl or cyclopentanedione; compounds having reactive halogens such as bis(2-chloroethylurea), 2-hydroxy-4,6-dichloro-1,3,5-triazine or compounds as described in U.S. Pat. Nos. 3,288,775 and 2,732,303, and British Patent Nos. 974,723 and 1,167,207; compounds having reactive olefins such as divinyl sulfone, 5-acetyl-1,3-diacryloylhexahydro-1,3,5-triazine and compounds as described in U.S. Pat. Nos. 3,635,718 and 3,232,763, and British Patent No. 994,864; N-methylol compounds such as N-hydroxymethylphthalimide and the compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isoxazole compounds as described in U.S. Pat. Nos. 3,321,313 and 3,543,292; halocarboxyaldehydes such as mucochloric acid; dioxane derivatives such as dihydroxydioxane and dichlorodioxane; and inorganic hardeners such as chrome alum and zirconium sulfate.

In place of the above compounds, a hardener precursor such as alkali metal bisulfite-aldehyde adducts, methylol derivatives of hydantoin or primary aliphatic nitroalcohols can be used.

The above photographic emulsion can contain surface active agents, individually or in admixture. The surface active agents are generally used as a coating aid, but they are sometimes employed for other purposes, for example, for improving the emulsion dispersion, increasing sensitization, improving the photographic characteristics, preventing static charging or adhesion, etc.

Examples of suitable surface active agents are natural surface active agents such as saponin; nonionic surface active agents such as alkylene oxide, glycerol or glycidol nonionic surface active agents; cationic surface active agents such as higher alkylamines, quaternary ammonium salts, pyridinium or other heterocyclic rings, phosphoniums or sulfoniums; anionic surface active agents containing acid groups such as carboxylic acid, sulfonic acid, phosphoric acid, sulfuric ester or phosphoric ester groups; and amphoteric surface active agents such as amino acids, aminosulfonic acids, or sulfuric or phosphoric esters of aminoalcohols.

The surface active agents which can be used are described, e.g., in U.S. Pat. Nos. 2,271,632, 2,240,472, 2,288,226, 2,739,891, 3,068,101, 3,158,484, 3,201,253, 3,210,191, 3,294,540, 3,415,649, 3,441,413, 3,442,654, 3,457,174 and 3,545,974; German Patent Application (OLS) No. 1,942,665 and British Patent Nos. 1,077,317 and 1,198,450, as well as in Ryohei Oda, et. al., *Kaimenkasseizai no Gosei to sono Oyo* (*Synthesis of Surface Active Agents and Their Applications*), Maki Publisher, Tokyo (1964), A.M. Schwartz et al., *Surface Active Agents*, Interscience Publications Inc., (1958), and J. P. Sisley et al., *Encyclopedia of Surface Active Agents*, Vol. 2, Chemical Publishing Company (1964).

The photographic emulsion can be, if desired, spectrally sensitized or supersenitized using cyanine dyes such as cyanine, merocyanine or carbocyanine dyes, individually or in admixture, or in combination with, for example, styryl dyes. Such color sensitization techniques are well known and are described, e.g., in U.S. Pat. Nos. 2,493,748, 2,519,001, 2,977,229, 3,480,434, 3,672,897, 3,703,377, 2,688,545, 2,912,329, 3,397,060, 3,615,635, and 3,628,964; British Patent Nos. 1,195,302, 1,242,588 and 1,293,862; German Patent Application (OLS) Nos. 2,030,326 and 2,121,780; Japanese Patent Publication Nos. 4936/68, 14030/69 and 10773/68; U.S. Pat. Nos. 3,511,664, 3,522,052, 3,527,641, 3,615,613, 3,615,632, 3,617,295, 3,635,721 and 3,694,217; and British Patent Nos. 1,137,580 and 1,216,203. The techniques can be optionally selected depending on the purpose and use of the light-sensitive material, that is, the wavelength region to be sensitized, the sensitivity desired, and the like.

In the silver halide photographic emulsion used in this invention for a color photographic light-sensitive material, a compound capable of reacting with an oxidation product of a developing agent to form a dye, that is, a so-called coupler, is incorporated in the light-sensitive photographic emulsion layer. The couplers have a structure so that they do not diffuse into other layers during production and processing.

In general, open-chain dikeomethylene compounds are used widely as yellow forming couplers. Specific examples of these yellow couplers are described in U.S. Pat. Nos. 3,341,331, 2,875,057 and 3,551,155; German Patent Application (OLS) No. 1,547,868; U.S. Pat. Nos. 3,265,506, 3,582,322, and 3,725,072; German Patent Application (OLS) No. 2,162,899; U.S. Pat. Nos. 3,369,895 and 3,408,194; German Patent Application (OLS) Nos. 2,057,941, 2,213,461, 2,219,917, 2,261,361 and 2,263,875.

5-Pyrazolone compounds are mostly used as magenta forming couplers but indazolone compounds and cyanoacetyl compounds can also be used as magenta forming couplers. Examples of these couplers are described in U.S. Pat. Nos. 2,439,098, 2,600,788, 3,062,653, and 3,558,319; British Patent No. 956,261; U.S. Pat. Nos. 3,582,322, 3,615,506, 3,519,429, 3,311,476 and 3,419,391; Japanese Patent Application Nos. 21454/73 and 56050/73; German Patent (DAS) 1,810,464; Japanese Patent Publication No. 2016/69; Japanese Patent Application No. 45971/73; and U.S. Pat. No. 2,983,608.

Phenol or naphthol derivatives are mostly used as cyan forming couplers. Examples of these couplers are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971; German Patent Application (OLS) No. 2,161,811; Japanese Patent Publication No. 28836/70; and Japanese Patent Application No. 33238/73.

In addition, a coupler of the type which releases a compound having a development inhibitory effect on color formation reaction (a so-called DIR coupler) or a compound which releases a compound having a development inhibitory effect also can be employed. Examples of these couplers are described in U.S. Pat. Nos. 3,148,062, 3,227,554, 3,253,924, 3,617,291, 3,662,328 and 3,705,201; British Patent No. 1,201,110; and U.S. Pat. Nos. 3,297,445, 3,379,529 and 3,639,417.

With respect to the above couplers, in order to satisfy the characteristics required in the light-sensitive materials, two or more different couplers can be used together in one layer, or a single coupler can be, of course, incorporated into two or more different layers.

The photographic emulsion is coated on a substantially planar support which undergoes no remarkable change in size during processing. Suitable examples of supports include rigid supports such as glass, metal or ceramics or flexible supports depending upon the purpose. Typical examples of flexible supports are those which are generally used for photographic light-sensitive materials, e.g., cellulose nitrate films, cellulose diacetate films, cellulose triacetate films, cellulose acetate butyrate films, cellulose acetate propionate films, polystyrene films, polyethylene terephthalate films, polycarbonate films, laminates of these films, thin glass films, papers, etc. Good results are also obtained with supports such as papers coated or laminated with baryta or a polymer of an $\alpha$-olefin, particularly having 2 to 10 carbon atoms, such as polyethylene, polypropylene or ethylene-butene copolymers, or synthetic resin films whose surface is roughened to improve the adhesion with other high molecular weight materials and improved printability as described in Japanese Patent Publication No. 19068/72.

The supports can be transparent or opaque depending upon the purpose of the light-sensitive material. With respect to the transparent supports, the supports can be colorless or can be colored with a dye or a pigment. The coloring of transparent supports has hitherto been practiced for X-ray films and is also described, e.g., in *J. SMPTE*, 67, 296 (1958).

Opaque supports include those which are intrinsically opaque, for example, papers, as well as films prepared by adding a dye or a pigment such as titanium oxide to a transparent film, synthetic resin films the surface of which has been treated in the manner as described in Japanese Patent Publication No. 19068/72, and papers or synthetic resin films which are rendered completely light-shielding by the addition of, e.g., carbon black, a dye, or the like. If the adhesion between the support and the photographic emulsion layer is insufficient, a layer having good adhesive properties to both the support and the photographic layer can be provided as a subbing layer. For further improving the adhesion to the support, the surface of the support can be subjected to a pre-treatment such as a corona discharge, an ultraviolet irradiation, a flame treatment, and the like. In this invention, synthetic resin film supports are preferably used, and in particular, cellulose ester film supports are preferred.

The photographic light-sensitive materials of this invention include black and white photographic light-sensitive materials such as negative or positive films for photography, black and white photographic papers, lith-type light-sensitive materials, microphotographic light-sensitive materials or light-sensitive materials for recording X-rays, and color photographic light-sensitive materials such as color negative films, color positive films, color papers or color photographic materials for use in the diffusion transfer process.

Each layer for the photographic light-sensitive material can be coated using various coating methods including dip coating, air-knife coating, curtain coating, and extrusion coating in which a hopper is used as described in U.S. Pat. No. 2,681,294. If desired, two or more layers can be coated at the same time in the manner as described in U.S. Pat. Nos. 2,761,791, 3,508,947, 2,941,898 and 3,526,528.

According to this invention, various advantages are provided, some of which are described below.

(1) Since the preparation and the coating of the coating composition can be performed in an organic solvent system (particularly, a mixed system of ketones, esters and alcohols), the preparation of a light-sensitive material is facilitated.

(2) At high temperature and high humidity, adhesion between the emulsion surfaces or between the emulsion surface and the other surface of the support is not likely to occur.

(3) The antistatic effect is not reduced with the passage of time.

(4) The surface of a photographic material which is rendered antistatic is not hazed prior to use and after development processing.

(5) Tribo-electric series of a photographic light-sensitive material can be changed depending upon the preparation and the use thereof.

(6) The antistatic effect and the anti-adhesion effect can be provided with no changes in photographic properties such as the sensitivity of a photographic light-sensitive material.

(7) The coated surface has good stability with time.

The following examples are given to illustrate the present invention in greater detail. Unless otherwise indicated, all parts, percentages, ratios and the like are by weight.

EXAMPLE 1

40 g of styrene-maleic anhydride copolymer was dissolved in 180 ml of acetone, and 21.6 g of benzyl alcohol was added to the solution, which was heated under reflux for 2 hours for esterification. The esterification degree was 20 mol % (in this case, the amount of benzyl alcohol added was considered to be sufficient for about 50 mol % esterification to occur, but the esterification time permitted only 20 mol % esterification).

Next, 150 ml of water was added to open the unreacted anhydride ring, and then 9 g of sodium hydroxide dissolved in 80 ml of methanol was added for neutralization to yield styrenemaleic acid sodium benzyl ester.

0.5 g of the resulting polymer (benzyl esterification degree: 20 mol %) was dissolved in a mixed solution of 30 ml of methanol and 70 ml of acetone to produce a coating composition. The coating composition was coated on a cellulose triacetate film support at a coverage of 60 cc/m² and dried at 100° C for 20 minutes. A gelatin-silver chlorobromoiodide emulsion was coated on the surface at the opposite side to the above coated surface to prepare a photographic film.

The antistatically-treated surface (the backing surface) of the film showed a surface specific resistance of $3.2 \times 10^9\ \Omega$ (at 65% relative hymidity and 23° C) and a time constant in electric discharge through leakage ($\tau$) of 1.5 seconds. Two film supports of 15 cm² were superposed with each other with the treated surface of each support being put to the outer side, thus making a test piece. The test piece was passed between two rubber rollers at a rate of 2.5 cm/sec, and the voltage, representing the amount of static charge as measured by a Faraday gauge (hereinafter referred to as "built-up static voltage") was measured as +2.5 V. A film in which an untreated support was used had a surface specific resistance of $1.7 \times 10^{15}\ \Omega$, a time constant in electric discharge through leakage of 107 seconds and a built-up static voltage of 39 V. The film having the treated surface was moisture-conditioned at 23° C and a relative humidity of 90%. Thereafter, the emulsion surface and the treated surface were kept in contact with each other at 40° C and a relative humidity of 90% for 1 day under a weight of 0.2 kg/cm², and then the adhesion was evaluated. Substantially no adhesion was found and hence no undesirable effect on the emulsion surface was observed.

The transparency of the film, after development processing with a developer having the following composition:

| | |
|---|---|
| p-Methylamino Phenol | 2.0 g |
| Hydroquinone | 5.0 g |
| Sodium Sulfite (anhydrous) | 100.0 g |
| Borax | 2.0 g |
| Water to make | 1 l |

was satisfactory with no haze.

EXAMPLE 2

0.5 g of styrene-maleic acid sodium p-butylbenzyl ester copolymer (esterification degree: 30 mol %) which was produced in the same manner as in Example 1 and 0.4 g of cellulose diacetate were dissolved in a mixed solution of 30 ml of methanol and 70 ml of acetone to produce a coating composition. The coating composition was coated on a cellulose triacetate film support at a coverage of 60 cc/m² and dried at 100° C for 20 minutes. An emulsion layer was provided at the opposite side to the treated surface to prepare a photographic film. The surface specific resistance, the time constant in electric discharge through leakage and the built-up static voltage were $7.0 \times 10^9\ \Omega$, 2.0 seconds and +5.4 V, respectively, as measured in the same manner as in Example 1. When the film was practically tested in a camera, no static marks were produced. The adhesive property with the emulsion surface was more satisfactory than that obtained with the benzyl-esterified copolymer of Example 1, which had no influence on the emulsion surface.

EXAMPLE 3

0.05 g of a benzyl-esterified copolymer (esterification degree: 20 mol %) which was produced in the same manner as in Example 1 and 0.05 g of cellulose triacetate were dissolved in a mixed solution of 20 ml of methanol, 70 ml of ethylene chloride and 10 ml of tetrachloroethane to make a coating composition.

The coating composition was coated on a polyethylene terephthalate film support at a coverage of 30 cc/m² and dried at 100° C for 20 minutes. A gelatin-silver bromoiodide emulsion layer was coated on the opposite side to the treated surface to prepare a photographic film. The surface specific resistance, the time constant in electric discharge through leakage and the built-up static voltage were $3.2 \times 10^9\ \Omega$, 1.0 second and −4.5 V, respectively, as measured in the same manner as in Example 1.

When the film was practically tested as to static charge by carrying the film on a stainless steel or rubber roller in an atmosphere of a relative humidity of 30% and 23° C, no static marks resulted. On the contrary, when an untreated film was tested as a comparative sample, many spot-like static marks were formed.

EXAMPLE 4

In the same manner as in Example 1, 1.0 g of a styrenemaleic anhydride copolymer was reacted with 10 ml of phenylethanol in 50 ml of acetone at 50° C for 10 hours to convert the copolymer into the phenylethyl ester. Then, 1.5 ml of a 10% aqueous solution of potassium hydroxide was added to convert the remaining carboxylic acids into potassium salts. To the reaction product, 20 ml of methanol, 20 ml of ethanol and 50 ml of acetone were added, and 0.5 g of methyl polymethacrylate was dissolved therein. The resulting coating composition was coated on a polyethylene terephthalate film support at a coverage of 300 cc/m² and dried at 120° C for 20 minutes. A gelatin-silver bromoiodide emulsion layer was coated on the opposite side to the treated surface to prepare a microphotographic film. The surface specific resistance, the built-up static voltage and the time constant in electric discharge through leakage were $5.2 \times 10^9\ \Omega$, 6.4 V and 1.5 seconds, respectively, as measured in the same manner as in Example 1.

This film was loaded in a camera and practically tested as to static charge in a room at 20° C and a relative humidity of 25%. No static marks appeared. In an untreated film which was subjected to the above practical testing, many spot-like and branch-like static marks were produced.

EXAMPLE 5

A red-sensitive silver halide emulsion layer, an intermediate layer, a green-sensitive silver halide emulsion layer, a yellow filter layer, a blue-sensitive silver halide emulsion layer and an uppermost layer each containing the additives shown in the table below were coated in that order on an undercoated cellulose triacetate film. Furthermore, the coating composition of Example 1 was coated on the opposite side of the support, thus preparing a color negative film. After exposure, the film was subjected to the following color development, and the same results were obtained as in Example 4.

| Color Developer | |
|---|---|
| Sodium Sulfate | 2.0 g |
| Sodium Carbonate (monohydrate) | 30.0 g |
| Potassium Bromide | 2.0 g |
| Benzyl Alcohol | 5.0 g |
| Hydroxylamine Sulfate | 1.6 g |
| 4-Amino-3-methyl-N-ethyl-N-($\beta$-hydroxyethyl)aniline | 4.0 g |
| Water to make | 1 l |

-continued

| | |
|---|---|
| Bleaching Solution | |
| Iron-Ethylenediaminetetraacetic Acid Sodium Salt | 100.0 g |
| Potassium Bromide | 60.0 g |
| Ammonium Hydroxide (28% aq. soln.) | 50.0 ml |
| Glacial Acetic Acid | 25.0 ml |
| Water to make | 1 l |
| Fixing Solution | |
| Sodium Sulfate | 10.0 g |
| Sodium Thiosulfate | 200.0 g |
| Water to make | 1 l |
| Stabilizing Bath | |
| Formalin (40%) | 10.0 ml |
| Water to make | 1 l |

The processing temperature was 35° C, and the processing times were as follows:

| | |
|---|---|
| Color Development | 3 minutes |
| Bleaching | 6 minutes |
| Washing | 3 minutes |
| Fixing | 6 minutes |
| Washing | 3 minutes |
| Stabilizing Bath | 3 minutes |

Example 1. The haze degree was measured before and after development, respectively, and as a result, the values shown in the following table were obtained.

$$\text{Haze Degree} = \frac{\text{Scattered Light}}{\text{Total Transmitted Light}} \times 100$$

| Styrene-Maleic Acid Ester Copolymer | Haze Degree Before Development | Haze Degree After Development |
|---|---|---|
| Not Esterified | 1.2 | 20.6 |
| n-Butyl Ester (50 mol% esterification) | 1.2 | 13.0 |
| Benzyl Ester (50 mol % esterification) | 1.2 | 1.1 |
| Benzyl Ester (20 mol % esterification) | 1.1 | 0.9 |
| Uncoated Support | 1.1 | 1.1 |

With regard to the straight chain alkyl esters other than those in the above table, i.e., methyl, ethyl, n-propyl, n-amyl and n-dodecyl ester, similar haze results was observed. That is, a clear difference after development processing between the straight chain alkyl esters and the benzyl ester was observed.

The photographic film on which the above copolymer was coated has good transparency either after coating or after development. However, the films on which the copolymer not esterified or the copolymer having a low esterification degree was coated, or the films on which the straight alkyl ester of the copolymer was coated were transparent after coating, but when they are subjected to development, the supports become white-opaque (in particular, the support of cellulose esters shows considerable haze).

TABLE

| | Red-Sensitive Silver Halide Emulsion Layer | Green-Sensitive Silver Halide Emulsion Layer | Blue-Sensitive Silver Halide Emulsion Layer | Intermediate Layer | Yellow Filter Layer |
|---|---|---|---|---|---|
| Coupler | 4-Chloro-1-hydroxy-N-dodecyl-2-naphthamide (0.88g/m²) | 1-(2,4,6-Trichlorophenyl)-3-[3-(2,4-di-t-amylphenoxy)-acetamido]benzamido-5-pyrazolone (0.75g/m²) | 3'-(2,4-Di-t-amylphenoxyacetamido)-α-(4-methoxybenzoyl)-acetanilide (1.31g/m²) | — | — |
| Spectral Sensitizer | bis(9-Ethyl-5-chloro-3-β-hydroxyethyl)-thiacarbocyanine bromide (6.51mg/m²) | bis(9-Ethyl-5-phenyl-3-ethyl)oxycarbocyanine isothiocyanate (5.23g/m²) | — | — | — |
| Stabilizing[1] Agent | (8.19mg/m²) | (7.71mg/m²) | (6.50mg/m²) | — | — |
| Hardener[2] | (15mg/m²) | (14mg/m²) | (20mg/m²) | (10mg/m²) | (11mg/m²) |
| Coating Aid[3] | (42mg/m²) | (51mg/m²) | (67mg/m²) | (56mg/m²) | (63mg/m²) |
| [4] | (53mg/m²) | (64mg/m²) | (84mg/m²) | (71mg/m²) | (80mg/m²) |
| Silver Halide/ Colloidal Silver | Silver Halide: Silver Bromoiodide Emulsion (silver iodide:5.5 mol%) (2.1g AgBrI/m²) | (1.2g AgBrI/m²) | (2.3g AgBrI/m²) | | Yellow Colloidal Silver |
| Thickness of Dry Film | 5 μ | 6 μ | 5 μ | 2 μ | 2 μ |

[1]5-Hydroxy-7-methyl-1,3,8-triazaindolizine
[2]2,4-Dichloro-6-hydroxy-1,3,5-triazine sodium salt
[3]Sodium p-dodecylbenzenesulfonate
[4]Sodium p-nonylphenoxypoly(ethyleneoxy)propanesulfonate

EXAMPLE 6

The procedures as described in Example 5 were repeated except that as a yellow forming coupler, α-pivaloyl-α-(1-benzyl-5-methoxy-3-hydantoinyl)-2-chloro-5-[γ-(2,4-di-tert-amylphenoxy)-butyramido]acetanilide was used, and as a magenta forming coupler, 1-(2,6-dichloro-4-methoxyphenyl)-3-{3-[α-(2,4-di-tertamylphenoxy)butyramido]benzamido}-5-pyrazolone was used.

EXAMPLE 7

The photographic films were prepared in the same manner as in Example 1 excepting that styrene-maleic acid copolymers having different esterification degrees were coated on cellulose triacetate films at a coverage of 0.3 g/m². Then, the photographic films were exposed and developed using the developer as described in

EXAMPLE 8

Two samples of color negative films of Example 5 were prepared, which were 35 mm × 35 mm in size. They were moisture-conditioned at 40° C and a relative humidity of 90% for one day. Then, the emulsion layer of one sample and the backing surface of the other sample were superimposed with a weight of 2 kg, and allowed to stand at 40° C and a relative humidity of 90% for one day. Thereafter, the emulsion layer and the backing surface were separated from each other, and the area of adhesion marks produced on the emulsion surface was measured. The results obtained are shown in the following table.

| Styrene-Maleic Acid Ester Copolymer* | Adhesion Area** |
|---|---|
| Not Esterified | 80 – 90% |
| Methyl Ester | 70 – 80% |
| n-Butyl Ester | 60 – 80% |
| Benzyl Ester | 20 – 40% |
| p-Butylbenzyl Ester | 20% |

*50 mol % esterification
**% of area adhered

As is apparent from the above table, the emulsion layer and the support are less likely to adhere at high humidity, according to this invention, as compared with the use of the styrene-sodium maleate copolymers which are esterified with straight chain alkyl ($C_1 - C_5$) groups or unesterified.

EXAMPLE 9

The same procedures as in Example 1 were repeated and the esterification degree of the styrene-maleic acid copolymer was varied, thus obtaining the curves shown in the figure. In the figure, Curves 1 and 2 are graphs showing the relation between the esterification degree and the built-up static voltage in using a stainless roller and a rubber roller, respectively.

In general, a static charge is generated in photographic films in the production process or on feeding the same as a product in a camera, and the discharge results in so-called static marks. This static charge is produced due to various factors. Between two materials which are remote in the tribo-electric series from each other, no large amounts of static charge are produced due to physical actions such as contact or rubbing which causes a static charge to be produced. In the preparation of photographic films and in the feeding of the films in a camera, most static charge difficulties occur with particular materials used for members and rollers. However, as is apparent from the figure, the tribo-electric series of photographic films can be varied by changing the esterification degree of the copolymer according to this invention, and therefore, the tribo-electric series of them can be intentionally made closer to those of the above materials.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide photographic layer and at least one layer containing a styrene-maleic acid copolymer having a molecular weight ranging from about 2000 to 500,000, containing 20 to 60 mol % styrene and 40 to 80 mol % maleic acid, and in which about 10 to 70 mol % of the carboxylic acid groups of the styrene-maleic acid copolymer is esterified with a compound represented by the following formula (I)

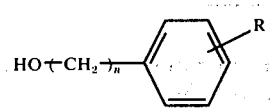

(I)

wherein R represents a hydrogen atom, an alkyl group having 1 to 4 carbon atoms or a phenyl group, and $n$ is 1 or 2.

2. The photographic light-sensitive material of claim 1, wherein said styrene-maleic acid copolymer is represented by the general formula (II)

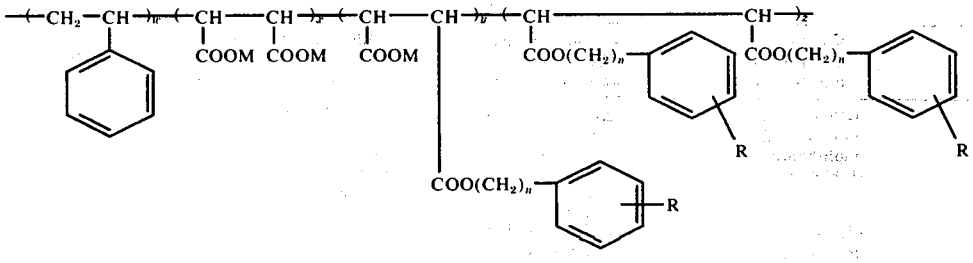

(II)

wherein $n$ is 1 or 2; $w$ is 20 to 60 mol %; $x$ is 0 to 40 mol %; $y + z$ is 10 to 70 mol %; $y$ is 0 to 70 mol %; $z$ is 0 to 20 mol %; M is an alkali metal atom; and R is a hydrogen atom, an alkyl group having 1 to 4 carbon atoms or a phenyl group.

3. The photographic light-sensitive material of claim 2, wherein 50 to 80 mol % of the carboxylic groups unesterified are in the form of the alkali metal salt thereof.

4. The photographic light-sensitive material of claim 1, wherein said styrene-maleic acid copolymer has a molecular weight ranging from about 2,000 to 500,000.

5. The photographic light-sensitive material of claim 1, wherein said styrene-maleic acid copolymer is present at a coverage of about 5 to 500 mg/m² of said support.

6. The photographic light-sensitive material of claim 1, wherein said material includes at least one silver halide photographic emulsion layer on said support and wherein said at least one layer containing a styrene-maleic acid copolymer comprises an uppermost layer on said silver halide emulsion layer.

7. The photographic light-sensitive material of claim 1, including a support having thereon at least one blue-sensitive silver halide emulsion layer, at least one green-sensitive silver halide emulsion layer, at least one red-sensitive silver halide emulsion layer and at least one layer thereon containing said styrene-maleic acid copolymer.

* * * * *